US005181793A

United States Patent [19]

Dekel

[11] Patent Number: 5,181,793

[45] Date of Patent: Jan. 26, 1993

[54] GUTTER DRAIN APPARATUS

[76] Inventor: Joseph Dekel, 4532 Jubilo Dr., Tarzana, Calif. 91356

[21] Appl. No.: 633,012

[22] Filed: Dec. 24, 1990

[51] Int. Cl.[5] ..... E01C 11/22; E01C 11/02; E04D 13/00

[52] U.S. Cl. ..... 404/4; 404/47; 52/11

[58] Field of Search ..... 52/11-15; 404/2-5, 47-49

[56] References Cited

U.S. PATENT DOCUMENTS

| | | | |
|---|---|---|---|
| 3,598,026 | 1/1969 | Johnson | 404/49 |
| 3,813,180 | 5/1974 | O'Brill | 404/48 |
| 4,506,484 | 3/1985 | Bartlett et al. | 52/489 X |
| 4,515,489 | 5/1985 | Thomann et al. | 404/4 |
| 4,621,939 | 11/1986 | Thomann et al. | 404/4 X |
| 4,630,962 | 12/1986 | Thomann et al. | 404/4 X |
| 4,815,247 | 3/1989 | Nicholas | 404/47 X |
| 4,912,888 | 4/1990 | Martin | 52/12 |
| 4,925,339 | 5/1990 | Smith | 404/47 |

*Primary Examiner*—Ramon S. Britts
*Assistant Examiner*—Nancy P. Connolly
*Attorney, Agent, or Firm*—Charles H. Schwartz; Ellsworth R. Roston

[57] ABSTRACT

Gutter drain apparatus for emplacement in concrete decking includes a drainage trough and a cap member adapted to be detachably retained over the open top of the trough. The device is protected from the inward pressure of expanding concrete by grooves formed on the top of side walls of the trough. The cap member has depending latching members each having an inwardly facing bevel. These are adapted to enter the grooves and to slip past and engage outwardly extending lips provided on the inner side of the grooves to detachably latch the cap member on the trough.

8 Claims, 3 Drawing Sheets

GUTTER DRAIN APPARATUS

BACKGROUND OF THE INVENTION

1. Field of the Invention

This invention relates to an improved gutter drain having a removable cap member and, more particularly, to apparatus of this type which is resistant to expansion of a concrete apron or slab in which the drain apparatus is emplaced.

2. Description of the Prior Art

Swimming pools are frequently surrounded by extensive concrete decking, and it is common practice to conduct swimming pool overflow and rainwater to a suitable surface level drain emplaced within the decking at selected locations. As illustrated by the drain apparatus disclosed in U.S. Pat. No. 4,815,888, the drain is frequently made of a polymer plastic trough section covered by an apertured polymer plastic cap or grate member which has depending skirts. These skirts cooperate with grooves on the walls of the trough for detachably mounting the cap member on the trough. It has also been proposed to detachably latch the cap member on the trough by forcing a beveled hook member on one of the members past a lip on the other.

However, when the concrete decking is heated by the sun, it will expand and exert inward pressure to squeeze the trough and cap member. This often causes the cap member to bulge and either pop open or be locked in position within the concrete and become difficult to remove.

SUMMARY OF THE INVENTION

According to the present invention, gutter drain apparatus is provided with protection means for protecting the apparatus from the inward pressure of concrete decking.

In particular, the apparatus of the present invention comprises an open-topped drainage trough having side walls with first cap retaining means on the side walls, a cap member for covering the open top of the trough and having second cap retaining means for detachably latching the cap member on the trough, and protection means for protecting the first and second cap retaining means from the effects of the inward pressure to maintain the cap member on the trough without diminishing the detachability of the cap member. The protection means comprises a groove formed at the top of each side wall of the trough. The groove is bounded by a first wall section contiguous with the open top of the trough and a second wall section spaced outwardly from the first wall section. The first cap retaining means is situated on the outward side of the first wall section of each groove. The second cap retaining means comprises a pair of latching members which depend :rom the cap member, each entering one of the grooves This brings the second cap retaining means into detachable latching engagement with the respective first cap retaining means.

The first cap retaining means comprises a lip extending outwardly from the first wall section of each groove, and the second cap retaining means comprises a pair of hook members for engaging the lips in each groove. The hook members each have an inwardly facing bevel extending upwardly and inwardly to an outwardly extending shoulder. The latching members are so spaced that when the cap member is placed on the trough with the latching members entering respective grooves, the application of pressure causes the bevels to slip past the lips until the lips engage the shoulders to snap the cap member in place and detachably latch it on the trough.

Because the elements forming the cap retaining means are protected by the grooves from the inward pressure of the concrete decking, the cap member of the apparatus of the present invention is less likely to pop off or be unduly difficult to detach.

BRIEF DESCRIPTION OF THE DRAWINGS

A clearer understanding of the present invention will be apparent from the following description and the drawings, wherein.

DESCRIPTION OF THE PREFERRED EMBODIMENT

Figure 1:
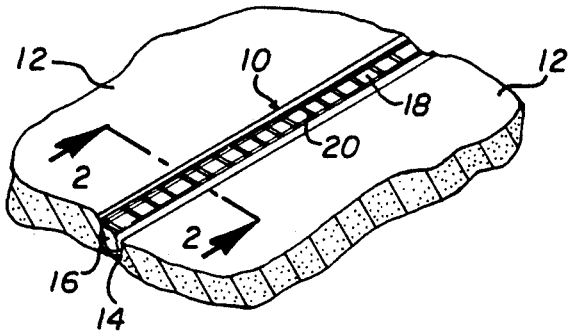
FIG. 1 is a partial perspective view of concrete decking in which gutter drain apparatus is emplaced.

FIG. 1 illustrates the installation of gutter drain apparatus 10 of the invention emplaced in a slab of concrete decking 12 which, typically, may be a concrete apron surrounding a swimming pool. The gutter drain apparatus includes a drainage trough 14 providing a drainage passageway 16 and a cap member 18 in which are formed transverse drainage slots 20. As is customary in the art, drainage trough 14 and cap member 18 are formed of a polymer plastic composition such as polyvinylchloride (PVC). As seen most clearly in FIG. 2, trough 14 has an open top 22 which is detachably covered by cap member 18 as will be explained more fully below.

Figure 2:
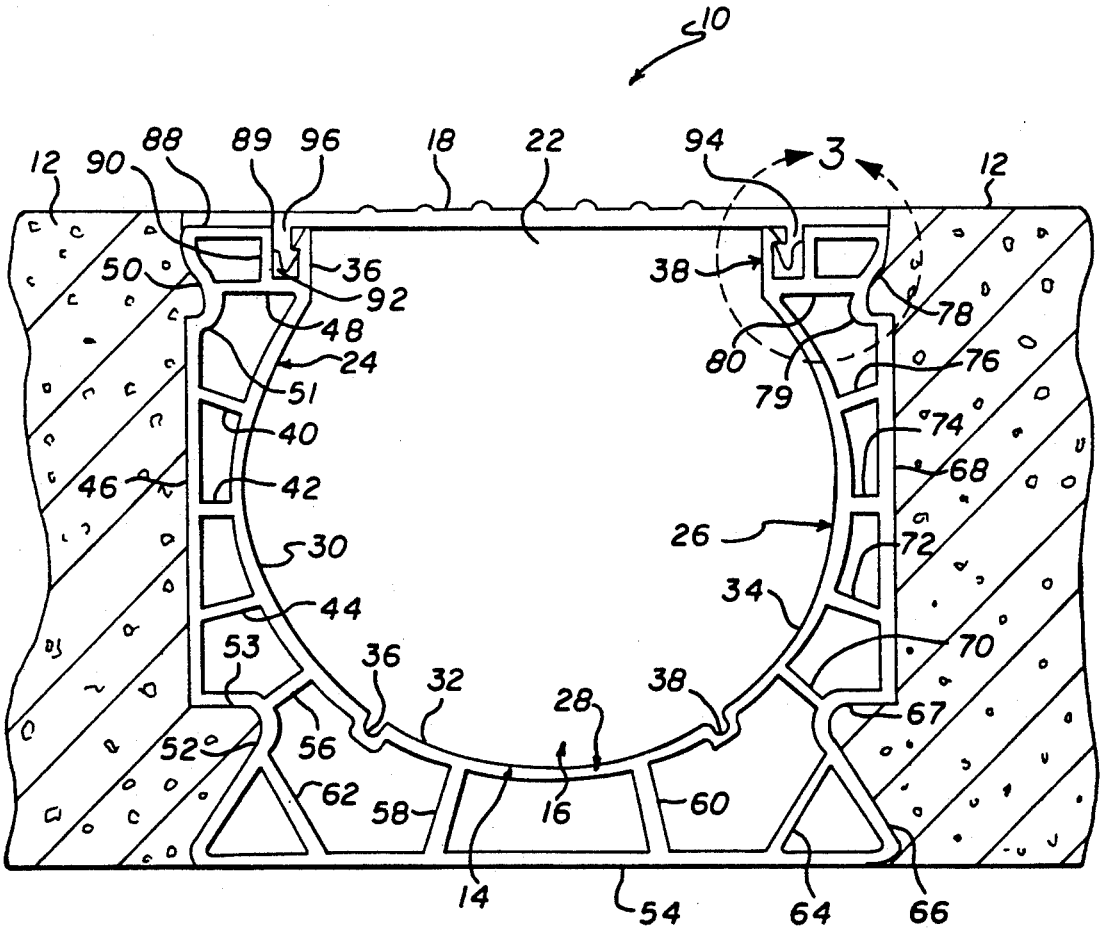
FIG. 2 is a section view along the line 2—2 of FIG. 1 showing a first embodiment of apparatus of the invention emplaced in concrete decking.

Trough 14, as seen in FIG. 2, may be considered as having a pair of side walls 24 and 26 on opposite sides of the open top 22 and a bottom wall 28. In actual fact, however, the inside wall of trough 14 is formed of a plurality of cylindrical wall segments 30, 32 and 84 connected by connecting grooved sections 36 and 38. Wall segments 30, 32 and 34 are arcuate and each forms a part of a circular cylindrical surface defining the main part of passageway 16. Open top 22 is bordered by a pair of generally vertical wall extensions 36 and 38 extending, respectively, upwardly from the tops of cylindrical wall segments 30 and 34.

As is clear from FIG. 2, the walls of trough 14 are hollow. Cylindrical wall segment 30 is connected by webs 40, 42 and 44 to a vertical outer wall 46. A web 48 connects the top of segment 30 to an inwardly indented outer wall section 50 extending inwardly from section 46 to form shoulder 51 and then upwardly and outwardly. An outer wall extension 52 extends from the bottom of wall section 46 inwardly to form shoulder 53 and then downwardly and outwardly to join a flat bottom outer wall section 54. A web 56 connects wall segment 30 to wall extension 52, and webs 58 and 60 connect bottom wall segment 32 to bottom outer wall section 54. Additional corner webs 62 and 64 connect bottom wall section 54 to outer wall extension 52 and an outer wall extension 66, respectively. Outer wall extension 66 extends inwardly and upwardly from bottom wall section 54 and then outwardly to form shoulder 67 which joins the bottom of an outer wall section 68. A web 70 connects wall extension 66 to wall segment 34, and webs 72, 74, and 76 connect outer wall section 68 to wall segment 34; A wall extension 78 extends inwardly from outer wall section 68 to form a shoulder 79 and then outwardly. The top of wall segment 34 is connected to wall extension 78 by a web 80. The top of wall section 78 is connected by a wall section 82 extending inwardly and then downwardly to web 80 As will be observed most clearly from FIG. 3, wall section 82 forms a corner 83. The vertical portion 84 of wall section 82 forms a groove 86 with wall extension 38. Similarly, wall extension 50 is joined by wall section 88 extending inwardly and downwardly to web 48 Wall section 88 forms a corner 89 and has a vertical portion 90. As was the case at the upper right corner shown in FIG. 3, a groove 92 is formed between wall section 90 and wall extension 36.

Figure 3:
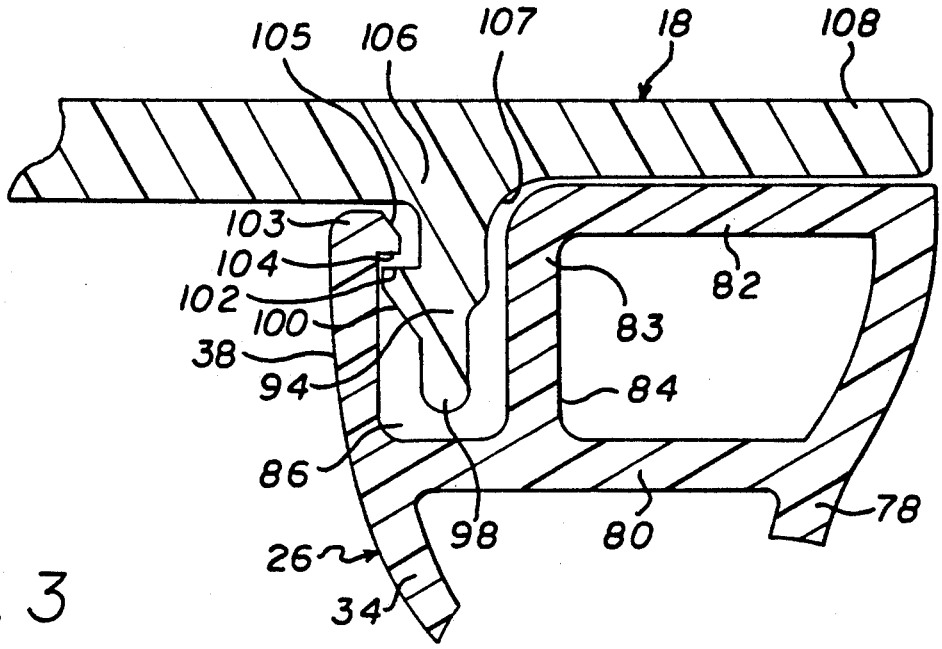
FIG. 3 is an enlarged partial section view of the portion of FIG. 2 encircled within the line 3.

In order to retain cap member 18 on trough 14, retaining means are provided on cap member 18 and on trough 14. The retaining means on cap member 18 includes a pair of longitudinally extending latching members 94 and 96, one for each side of the trough. Referring to FIG. 3, which shows the retaining means in detail, latching member 94 extends downwardly from cap member 18 to a tip 98. A bevel 100 extends upwardly and inwardly from a point above tip 98, terminating in an upwardly facing shoulder 102 which extends outwardly from bevel 100 to a base portion 106 of latching member 94. Base portion 106, which is somewhat thicker than the tip portion 98, forms an arcuate corner 107 with the outer portion 108 of cap member 18. It will be understood that the structure of latching member 96 and the structures bordering groove 92 are substantially the same as that just described and shown in FIG. 3. The retaining means on trough 14 takes the form of an outwardly extending lip 108 at the top of wall extension 38. This lip forms a downwardly facing shoulder 104. The top of lip 103 includes an upwardly and outwardly facing sloped surface 105.

Figure 4:
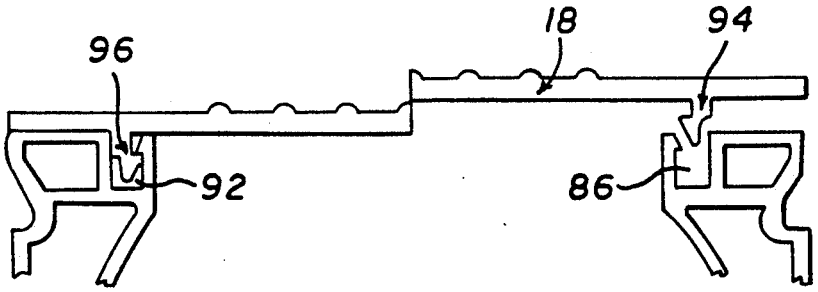
FIG. 4 is a partial view of the embodiment of FIG. 2 showing how the cap member is snapped into position.

In use, cap member 18 is placed on trough 14 with latching members 94 and 96 entering respective grooves 06 and 92, as is shown for latching member 94 at the right side of FIG. 4. Latching members 94 and 96 are so positioned that bevel 100 will ride on sloped surface 105 of lip 103. Pressure is applied to cap member 18 forcing bevel 100 to slip over sloped surface 105 due to the flexibility of the plastic material of which cap member 18 and trough 14 are made, enabling latching members 94 and 96 to snap into the respective grooves 86 and 92. This brings shoulder 102 above bevel 100 into engagement with shoulder 104 on lip 103, latching cap member 18 on trough 14, as is shown for latching member 94 in FIG. 8 and for latching member 96 at the left side of FIG. 4. Once cap member is thus snapped in place, it is not easily separated from the trough. However, because of the flexibility of the plastic material from which the cap member and trough are made, latching member 94 and 96 can be manipulated within the respective grooves 86 and 92 to remove cap member 18 from the trough.

Grooves 86 and 92 protect the retaining means from the inward pressure of expanding concrete. This pressure is applied to the outer surface of wall extensions 78 and 50 and to the edges of outer portions 108 of cap member 18. The pressure on surface 78 causes inward shifting of wall section 82, corner 88 and vertical wall portion 84 which have room to move into groove 86 before corner 83 engages corner 107 and vertical wall portion 84 engages base portion 106 of retaining member 94. Thus, the latching of shoulder 102 on lip 103 is not affected by this inward pressure. The inward pressure on the edges of outer portions 108 of cap member 18 may bring shoulder 102 into firmer engagement with lip 103. However, this enhancement of the latching action between shoulder 102 and lip 103 will not prevent detachment of shoulder 102 from lip 103; latching member 94 will still be manipulable within the space provided by groove 86 making it possible to detach cap member 18 from trough 14.

Figure 6:
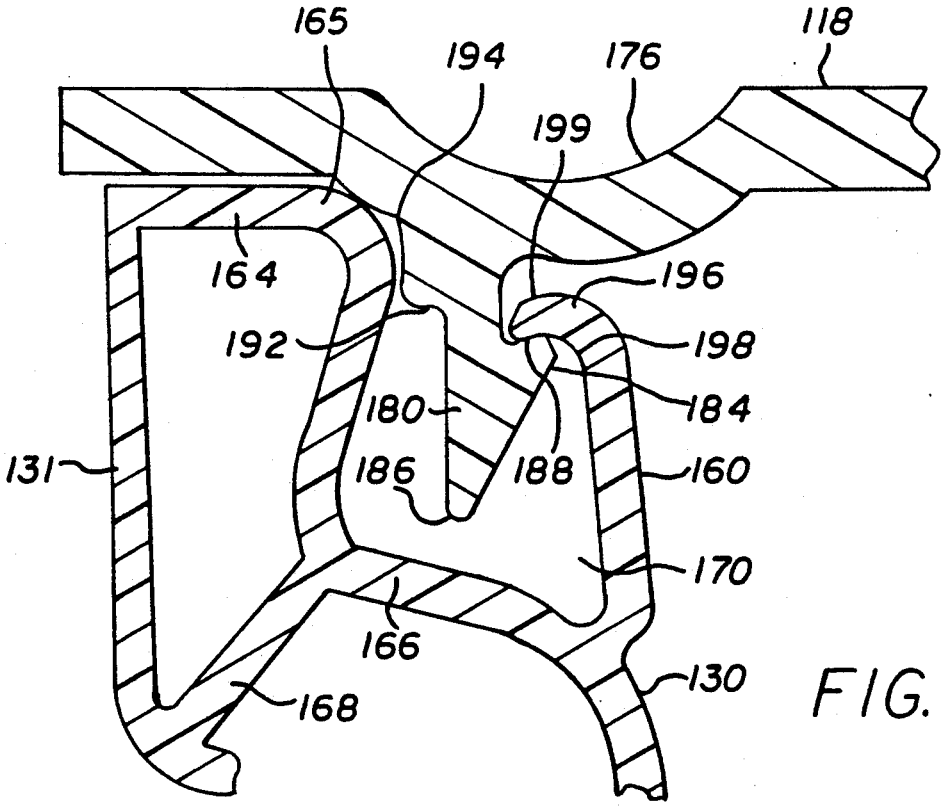
FIG. 6 is an enlarged partial section view of the portion of FIG. 5 encircled within the line 6.
Figure 5:
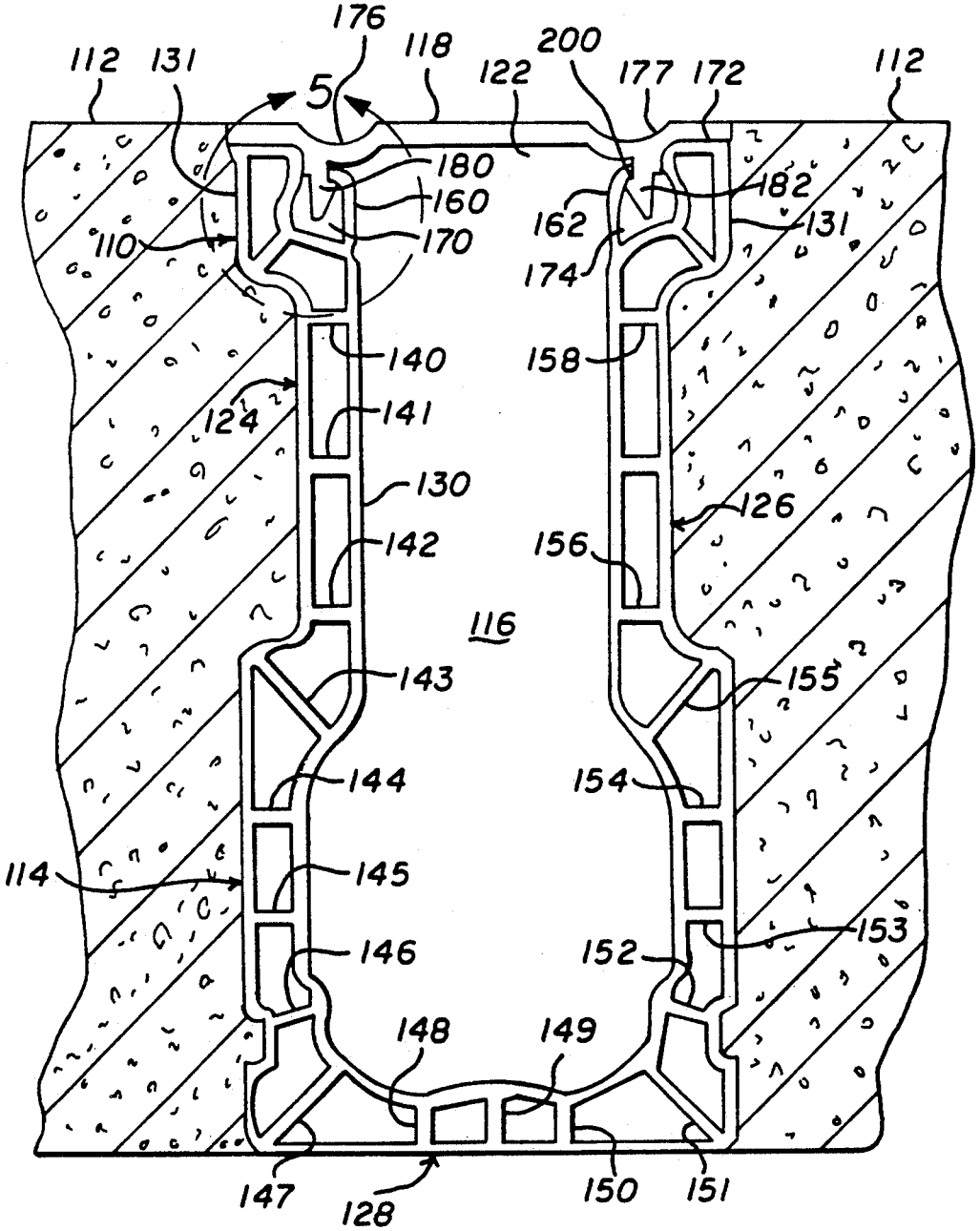
FIG. 5 is a section view corresponding to the view of FIG. 2 showing a second embodiment of apparatus of the invention.

While the embodiment of FIGS. 2 and 3 employs a trough 14 with a generally circular passageway 16, the embodiment of FIGS. 5 and 6 employs a trough 114 having a generally rectangular passageway 116. As before, the gutter drain apparatus 110 shown in FIG. 5 is emplaced in concrete decking 112. A cap member 118 covers the open lop 122 of trough 114 and has drain apertures (not shown) at spaced points therealong. Both the trough and cap member are formed of a suitable plastic, such as polyvinylchloride.

Trough 114 has the same hollow wall construction as is used in the embodiment of FIG. 2 and includes side walls 124 and 126 and a bottom wall 128. These walls are formed, in part, by a continuous inner wall section 130. An outer wall section 131 is joined to inner wall section 130 by a plurality of spaced webs 140–150. There are inner wall extensions 160 and 162 extending upwardly from the tops of inner wall section 130 at the left and right of opening 122 respectively. As best seen in FIG. 6, at the left side of top 122, a wall section 164 extends inwardly rom the top of outer wall section 131 to a corner 165 and then downwardly and outwardly until it joins an inwardly and downwardly extending wall section 166 which joins inner wall section 130 at the point from which wall extension 162 extends upwardly A web 168 extends between outer wall section 13 and the bottom of wall section 164. Wall extension 160 and wall section 164 form a groove 170. Similarly structural details are provided to the right of top 122 as shown in FIG. 5 wherein wall section 172 and wall extension 162 form a groove 174

Cap member 118 has a pair of longitudinally extending water collection channels 176 and 177 formed in its top surface. A pair of longitudinally extending latching members 180 and 182 extend downwardly from cap member 118. A bevel 184 extends upwardly and inwardly from a lower tip 186 to a shoulder 188 which extends outwardly to a base portion 190 of latching member 180. The other side of base portion 190 extends past the outward side of bevel 184 to form a shoulder 192 and merges with the bottom of cap member 118 to form a corner 194 opposite corner 165. Latching member 182 is similarly constructed.

The top of wall extension 162 has a lip 196 which extends outwardly to form a downwardly facing shoulder 198 Above shoulder 198, lip 196 has a sloped surface 199. Likewise, wall extension 162 has an outwardly extending lip 200 also forming a downwardly facing shoulder and having a sloping surface above the shoulder The operation of the embodiment of FIG. 5 is substantially the same as the operation of the embodiment of FIG. 2. Cap member 118 is placed over trough 114 with latching members 180 and 182 inserted into grooves 170 and 174. Latching members 180 and 182 are so positioned that the bevel 184 on latching member 180 engages sloping surface 199 on lip 196, and the bevel on latching member 182 engages the sloping surface of lip 200. Downward pressure on cap member 118 causes the bevels on latching members 180 and 182 to slip by respective lips 196 and 200 to bring the shoulders above the bevels into engagement with the shoulders created by the lips and snap cap member 118 into place. This latches cap member 118 on the trough. Inward pressure by concrete 112 on the side walls of trough 114 and on the edges of cap member 118 will not, in this embodiment as in the embodiment of FIG. 2, cause popping off or binding of cap member 118 Grooves 170 and 174 keep the pressure from adversely affecting the latching action between latching members 180 and 182 and lips 196 and 200, respectively. Removal of cap member 118 is not impeded, because grooves 170 and 174 permit sufficient manipulation of latching members 180 and 182 to release them from latching engagement with lips 196 and 200, respectively.

Although the present invention has been described with reference to two preferred embodiments, it is to be appreciated that various adaptations and modifications may be made and that the invention is only to be limited by the appended claims.

The invention claimed is:

1. Gutter drain apparatus for emplacement in concrete decking for draining liquids from the surface thereof, said gutter being subject to inward pressure upon expansion of said concrete decking, said gutter drain apparatus comprising:

a drainage trough adapted to be installed below grade in said decking and having an open top, said trough having side walls, and first retaining means including a lip portion on said side walls;

a cap member for covering said open top of said trough, said cap member having second retaining means including a hook portion for cooperation with said lip portion of said first retaining means for detachably latching said cap member on said trough, protection means for forming a spacing for protecting said first and second retaining means from the effects of said inward pressure to maintain said cap member on said trough without diminishing the removability of said cap member notwithstanding said inward pressure; and wherein said protection means comprises a U-shaped groove formed at the top of each of said side walls, said U-shaped groove being bounded by a first wall section contiguous to said open top, a second wall section spaced outwardly from said first wall section and an interconnecting section extending between the first and second wall sections, and wherein said first retaining means is situated on the outward side of said first wall section.

2. The gutter drain apparatus of claim 1, wherein said second retaining means comprises a pair of hook latching members depending from said cap member, each of said hook latching members entering one of said grooves when said cap member is placed on said trough to bring said hook latching members of said second retaining means into releasable latching engagement with said lip portion of said first retaining means.

3. The gutter drain apparatus of claim 2, wherein said lip portion of said first retaining means comprises a lip extending outwardly from said first wall section of each groove and said hook members of said second retaining means engages each said lip.

4. The gutter drain apparatus of claim 3, wherein each of said hook latching members has an inwardly facing bevel extending upwardly and inwardly to an outwardly extending shoulder to form said hook member, said hook latching members being so spaced that when said cap member is placed on said trough with said hook latching members entering respective ones of said grooves, the application of pressure causes said bevels to slip past said lips until said lips engage said shoulders to snap said cap member in place with said cap member releasably latched on said trough.

5. The gutter apparatus of claim 4, wherein each of said hook latching members has a lower end and said bevels are located above said lower ends.

6. The gutter drain apparatus of claim 4 wherein each of said hook latching members has a lower end and said bevels extend upwardly from said lower ends.

7. The gutter drain apparatus of claim 1, wherein said trough and cap member are formed of a resilient polymer plastic material.

8. The gutter drain apparatus of claim 4, wherein said trough and cap member are formed of a resilient polymer plastic material.

* * * * *